US005186604A

United States Patent [19]

Iorio et al.

[11] Patent Number: 5,186,604

[45] Date of Patent: Feb. 16, 1993

[54] ELECTRO-RHEOLOGICAL DISK PUMP

[75] Inventors: Vincent M. Iorio, Annapolis, Md.; Luke W. Loy, Washington, D.C.

[73] Assignee: The United States of America as represented by the Secretary of the Navy, Washington, D.C.

[21] Appl. No.: 812,477

[22] Filed: Dec. 23, 1991

[51] Int. Cl.[5] ..... F01D 1/36

[52] U.S. Cl. ..... 415/90; 415/200; 417/50

[58] Field of Search ..... 415/200, 90, 206; 417/50; 60/326

[56] References Cited

U.S. PATENT DOCUMENTS

| | | | |
|---|---|---|---|
| 1,061,142 | 5/1913 | Tesla | 415/90 |
| 2,651,258 | 9/1953 | Pierce | 60/326 |
| 3,516,510 | 6/1970 | Coburn et al. | 60/326 |
| 3,552,275 | 1/1971 | Chaney et al. | 91/418 |
| 3,599,428 | 8/1971 | Chaney et al. | 60/326 |
| 4,255,081 | 3/1981 | Oklejas et al. | 415/90 |
| 4,402,647 | 9/1983 | Effenberger | 415/90 |
| 4,532,853 | 8/1985 | Stangroom | 91/165 |
| 4,773,819 | 9/1988 | Gurth | 415/90 |
| 4,940,385 | 7/1990 | Gurth | 415/206 |

*Primary Examiner*—Thomas E. Denion

*Attorney, Agent, or Firm*—Gary G. Borda

[57] ABSTRACT

The invention is directed to a device for pumping electro-rheological fluids comprising a casing that defines an inner rotor chamber having a central inlet opening and a peripheral discharge opening. Rotatably disposed within said chamber is a rotor for imparting energy to the pumped electro-rheological fluid comprising of a plurality of non-conducting coaxial substantially parallel spaced disks. On one face of each disk are embedded one or more electrodes and on the opposing face of each disk are attached one or more conductive surfaces. By selectively applying an electric charge to the embedded electrodes, an electric field is produced between the electrodes and the conducting surfaces of adjacent disks. As a result, the viscosity of the electro-rheological fluid exposed to the applied electric field is increased thereby producing electro-rheological fluid vanes between adjacent disks. When the rotor is placed in rotation and a voltage is applied to the embedded electrodes, the electro-rheological fluid that is not exposed to the applied electric field is accelerated from the center of the rotor towards the outer periphery by the combined action of the electro-rheological fluid vanes and the friction force acting between the fluid and the rotating disks.

21 Claims, 2 Drawing Sheets

Prior Art

ELECTRO-RHEOLOGICAL DISK PUMP

STATEMENT OF GOVERNMENT RIGHTS

The invention described herein may be manufactured and used by or for Government of the United States of America for governmental purposes without the payment of any royalties thereon or therefor.

BACKGROUND OF THE INVENTION

FIELD OF THE INVENTION

The present invention relates generally to rotary disk pumps and, more particularly, to an improved rotary disk pump for pumping electro-rheological fluids.

BRIEF DESCRIPTION OF RELATED ART

Electro-rheological fluids are slurries usually composed of a non-conducting fluid medium and particulates. A typical slurry may contain 30 percent particulate and 6 percent water by weight, mixed in a dielectric liquid. When exposed to an electric field, the viscosity of the electro-rheological fluid varies as a function of the magnitude of the electric field applied to the fluid. The application of a high voltage electric potential across a small gap, typically on the order of 1 to 2 mm, causes the fluid located in the gap to become more viscous. This effect, sometimes referred to as the Winslow effect or the electroviscous effect, is broadly described in Winslow U.S. Pat. Nos. 2,417,850 and 3,047,507.

Prior art devices utilizing electro-rheological fluids (also called electroviscous fluids) typically retain the fluid in a gap between two electrically conductive members which serve as electrodes. When no electrical potential is applied across the electrodes, the electro-rheological fluid will flow freely. Upon application of an electrical potential to the electrodes, the water absorbed in the particulate forms induced dipoles which align the particles between the electrodes thus resulting in an increase in fluid viscosity in the localized area between the electrodes. The increase in fluid viscosity is proportional to the strength of the applied electric field and, depending upon the magnitude of the electrical potential and other factors, the fluid can become solid. Upon removal of the electric potential, the fluid reverts to its original viscosity.

Problems have been encountered in the transfer of electro-rheological fluids. Because electro-rheological fluids are slurries, they tend to be abrasive. Due to the close tolerances required of components found in many pumping devices, electro-rheological fluids can cause accelerated abrasive wear on such components. Conversely, the close tolerances required of pumping devices tend to damage the particulates in the electro-rheological fluids, thus, destroying the electroviscous properties of the fluid.

Rotary disk pumps have been used to transport slurries. Such pumps were patented early in this century by Tesla in U.S. Pat. No. 1,061,142. Prior art disk pumps have utilized a plurality of coaxial spaced vaneless rotating annular disks as rotors. Disk pumps transfer a centrifugal acceleration to the pumped fluid through frictional forces between the rotating disks and the fluid. Generally, axially directed fluid enters these pumps through inlets located near the axis of rotation, located at the center of the disks, and is accelerated radially outward. Although pumps of this type have been known for many years, they have not gained widespread use due to their low efficiency.

Disk pumps have been unable to compete effectively with vaned impeller type centrifugal pumps due to the higher efficiency of vaned centrifugal pumps relative to disk pumps. One major cause of the low efficiency associated with disk pumps is the energy loss incurred due to the lack of smooth transition from an axially directed fluid flow to a radially directed flow. Prior art disk pumps, in order to achieve marginally acceptable efficiencies, have had to maintain a close tolerance of spacing between the disks.

The present invention overcomes the aforementioned problems encountered when pumping slurries with prior art fluid pumping devices.

SUMMARY OF THE INVENTION

In accordance with the present invention, an improved disk pump for pumping electro-rheological fluids is provided. The present invention is a device for pumping electro-rheological fluids comprising a casing that defines an inner rotor chamber having a central inlet opening and a peripheral discharge opening. Rotatably disposed within said chamber is a rotor for imparting energy to the pumped electro-rheological fluid.

The rotor of the present invention is comprised of a plurality of non-conducting coaxial substantially parallel spaced disks. On one face of each disk are embedded one or more electrodes and on the opposing face of each disk are attached one or more conductive surfaces. All the disks or only selected pairs of disk could have embedded electrodes and conductive surfaces as described above. The rotor is connected to means for applying an electric charge to the embedded electrodes and for setting the rotor in rotation.

By selectively applying an electric charge to the embedded electrodes, an electric field is Produced between the electrodes and the conducting surfaces of adjacent disks. As a result, the viscosity of the electro-rheological fluid exposed to the applied electric field is increased thereby producing electro-rheological fluid vanes between adjacent disks.

When the rotor is placed in rotation with no voltage applied to the embedded electrodes, the fluid is accelerated from the center of the rotor towards the outer periphery by the friction force acting between the fluid and the rotating disks. When the rotor is placed in rotation and a voltage is applied to the embedded electrodes, the electro-rheological fluid that is not exposed to the applied electric field produced between the electrodes and the conducting surfaces of adjacent disks is transported by the combined action of the electro-rheological fluid vanes and the friction acting between the fluid and the rotating disks.

OBJECTS OF THE INVENTION

Accordingly, it is an object of the present invention to provide a disk pump of increased efficiency. More particularly, it is an object of the present invention to provide an improved disk dump for the pumping of electro-rheological fluids.

It is a further object of the present invention to provide a device of simple construction so as to reduce the possibility of damage to the device from pumping electro-rheological fluids. Furthermore, the present invention is intended to be inherently abrasion resistant.

It is still a further object of the present invention to provide a device that will pump electro-rheological fluids without damaging the electro-rheological particulate.

Other objects and advantages of the present invention will become apparent to those skilled in the art upon a reading of the following detailed description taken in conjunction with the drawings and the claims supported thereby.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
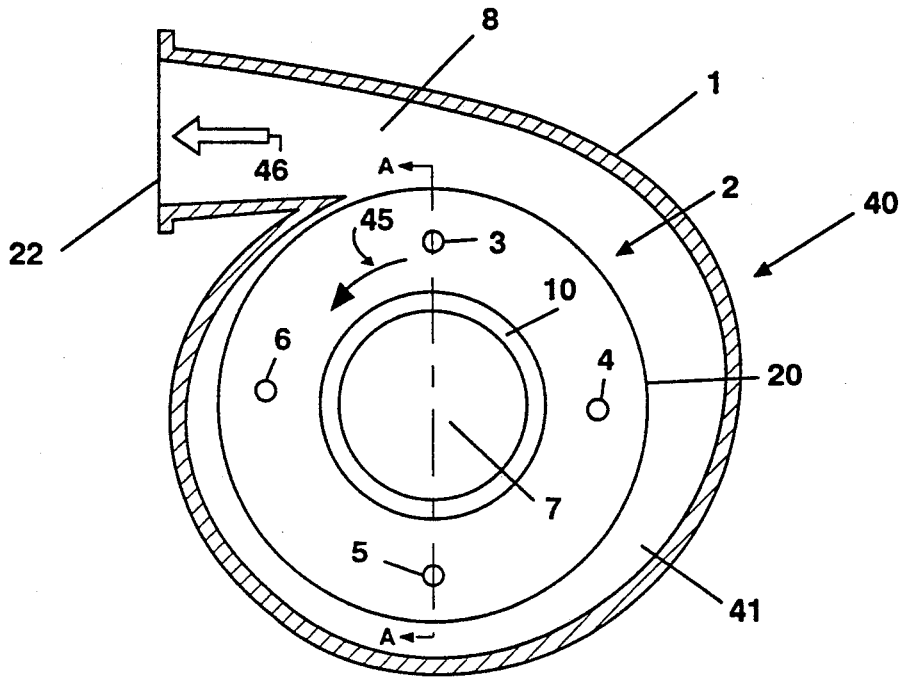
FIG. 1 is a vertical section side view of a prior art disk pump showing a volute casing and an annular rotor disk.

Referring now to the drawings, and particularly to FIG. 1, there is shown a vertical section side view of a disk pump, generally identified as item 40. Disk pump volute casing 1 defines an interior rotor chamber 41. Mechanical seals (not shown), well known in the art, may be used to prevent the leakage of pumped fluid from interior rotor chamber 41 of volute casing 1 and to seal interior rotor chamber 41 of volute casing 1 from the outside atmosphere. Rotatably disposed within interior rotor chamber 41 is rotor 2, shown in end view in FIG. 1 and in sectional view in FIG. 2. Items 3, 4, 5 and 6, depicted in end view, are pins which are parallel to the rotational axis of rotor 2 and extend through the multiple disks of rotor 2. Item 7 identifies a central inlet aperture in rotor 2. Central inlet aperture 7 is coaxially aligned with an inlet opening (not shown) at one end of volute casing 1. Item 8 defines a spiral shaped cavity within interior rotor chamber 41 of volute casing 1 but external to the outer periphery of rotor 2. Peripheral discharge opening 22 is positioned to direct the pumped fluid out of cavity 8 in a direction tangential to rotor 2 as indicated by directional arrow 46.

Figure 2:
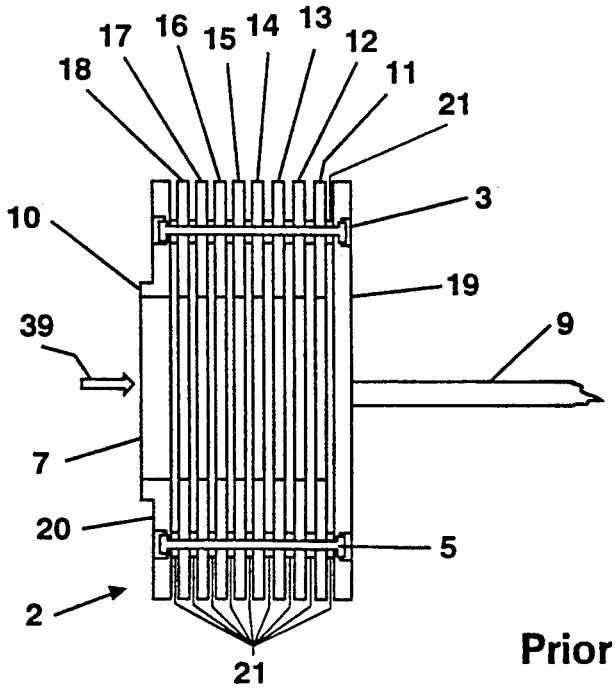
Prior Art Fig. 2
FIG. 2 is a sectional view of the prior art disk pump rotor taken along line A—A if FIG. 1 showing a plurality of rotor disks.

Now referring to FIG. 2, there is shown a sectional view of rotor 2, taken along line A—A of FIG. 1, wherein shaft 9 is rotated by an external power source (not shown). The end of shaft 9 that attaches to the external power source extends through the end of volute casing 1 opposite the end containing the inlet opening. The opposite end of shaft 9 is rigidly connected to a circular rotor hub 19. A plurality of spaced circular rotor disks 11 to 18 are attached in substantially parallel alignment to rotor hub 19 and annular end plate 20. Annular end plate 20 has a central inlet aperture 7 having an outer lip identified by numeral 10. Inlet aperture 7 and outer lip 10 are positioned to receive axial inlet flow through the coaxial opening in volute casing 1.

The number of disks and the interdisk spacing can be varied to meet specific pumping requirements. Generally, interdisk spacing increases with increasing disk diameter while initial fluid viscosity and the number of disks increases with increasing capacity and discharge head required. Rotor disks 11 to 18 are assembled coaxially between rotor hub 19 and annular end plate 20 and are held in place by pins 3 and 5, shown in FIG. 2, and pins 4 and 6, not shown in FIG. 2. Alternatively, rotor disks 11 to 18, rotor hub 19 and annular end plate 20 may be bolted together or held together by other suitable fastening methods. Rotor disks 11 to 18 are held in fixed substantially parallel alignment relative to each other and to rotor hub 19 and annular end plate 20 by disk spacers 21 which are placed around pins 3, 4, 6 and 6 and are located between each of the rotor disks 11 to 18 and between rotor disks 11 and 18 and rotor hub 19 and annular end plate 20, respectively.

Generally, prior art disk pumps, such as disk pump 40, centrifugally accelerate the pumped fluid through frictional (viscous) forces between rotating rotor disks 11 to 18 and the fluid. Fluid enters the pumping mechanism by flowing through central inlet aperture 7 as depicted by directional arrow 39. As shown, rotor 2, when in operation, spins in a counterclockwise direction as represented by directional arrow 45. Fluid entering the central inlet aperture 7 is accelerated as a result of the skin friction between the fluid and rotating rotor disks 11 to 18. In this example, rotating rotor disks 11 to 18 impart a counterclockwise momentum to the fluid which begins to move in a counterclockwise circumferential direction along and between rotor disks 11 to 18. The direction of travel of the fluid generally defines a spiral path as the fluid is accelerated to higher speeds while making several rotations within the spaces between rotor disks 11 to 18 before being cast by centrifugal force into spiral shaped cavity 8. The fluid is then discharged under pressure from pump discharge opening 22 as represented by directional arrow 46.

Figure 3:
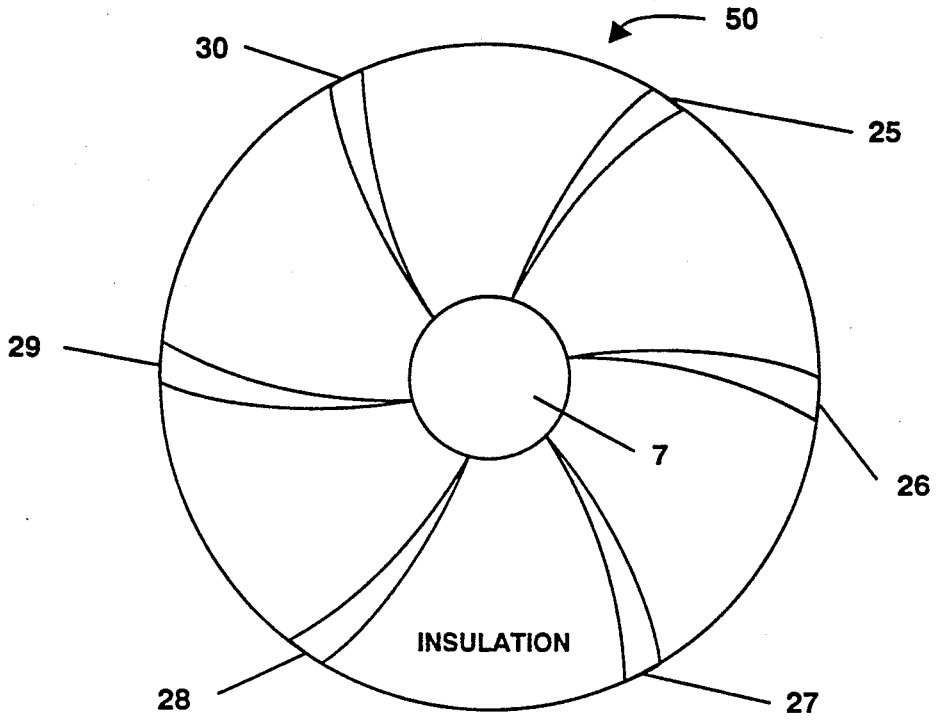
FIG. 3 is a side view of a rotor disk modified in accordance with the present invention.
Figure 4:
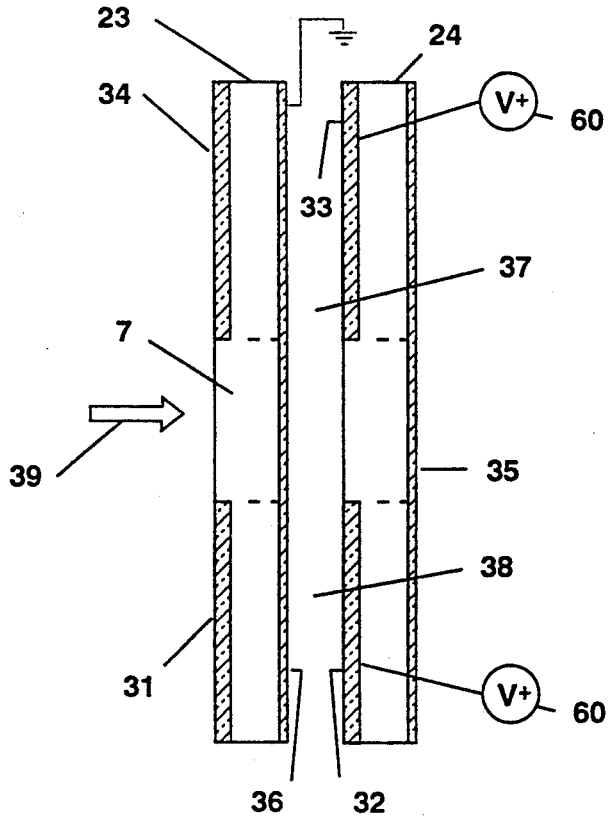
FIG. 4 is sectional view of rotor disks modified in accordance with the present invention.

Referring now to FIGS. 3 and 4, FIG. 3 is a side view of a rotor disk 50 modified in accordance with the teachings of the present invention and FIG. 4 is a side view of adjacent rotor disks 23 and 24 modified in accordance with the teachings of the present invention. Modified rotor disks 23, 24 and 50 are made of a non-conducting material which acts as an electrical insulator. On one face of each of modified rotor disks 23, 24 and 50 are attached electrodes shown as 25 to 30 in FIG. 3 and 31, 32, 33 and 34 in FIG. 4.

Electrodes 25 to 34 have a predetermined shape and are selectively located on the disk face. The electrodes can be placed on or embedded into the non-conducting material of the disks such that there are alternating areas of conductive and non-conductive surfaces around the disk as shown, for example, in FIG. 3. The electrodes can be in the general shape of an impeller blade section as shown, for example, by electrodes 25 to 30 in FIG. 3. The electrodes can extend from the outer perimeter of central opening 7 to the outer periphery of rotor disk 50, as shown by way of example by items 25 to 30 in FIG. 3, or can cover any lesser or greater portion of the rotor disk as may be desirable for specific applications. Electrodes 25 to 34 are electrically connectable to a suitable electric power source. While in operation, the electrodes have a voltage (V+) selectively applied to them from a suitable electric power source 60.

On the opposing face of modified rotor disks 23, 24 and 50 are attached electrically conductive surfaces as represented by items 35 and 36 in FIG. 4. These electrically conductive surfaces can cover the entire face of the rotor disk or can be selectively shaped and placed opposite the electrodes of adjacent rotor disks. While in operation, the conductive surfaces are grounded. In another embodiment of the present invention, surfaces 35 and 36 could be electrodes in order to receive an applied voltage.

A disk pump modified in accordance with the teachings of the present invention will be used to pump electro-rheological fluids. Referring now to FIG. 4 as an illustrative example, electro-rheological fluid enters through central inlet opening 7, as represented by directional arrow 39, and fills the space between rotor disks 23 and 24. The application of high voltage to embedded electrodes 32 and 33 will produce an electrical potential across gaps 37 and 38 defined by the area between and contiguous with embedded electrodes 32 and 33 and conductive surface 36 of adjacent rotor disks 23 and 24. The resulting electric potential will cause the portion of the electro-rheological fluid located in gaps 37 and 38 between embedded electrodes 32 and 33 and conductive surface 36 to form electro-rheological fluid vanes. The shape of the electro-rheological fluid vanes is determined by the shape of the embedded electrodes as depicted, for example, by embedded electrodes 25 to 30 in FIG. 3. The electro-rheological fluid vanes are composed of fluid with an increased viscosity relative to the viscosity of the remaining electro-rheological fluid located between rotor disks 23 and 24 but not contiguous with embedded electrodes 32 and 33 and conducting surface 36. Depending on the intensity of the electric field, the vanes can even be solid.

As rotor disks 23 and 21 rotate about their common axis, the electro-rheological fluid not comprising the electro-rheological fluid vanes is accelerated outward from central opening 7 toward the periphery of rotor disks 23 and 24 by the combined action of centrifugal force and the electro-rheological fluid vanes. The presence of the electro-rheological fluid vanes will greatly increase the efficiency of the disk pump by converting it during operation into a centrifugal impeller type pump. The fluid capacity and discharge head can effectively be varied by controlling the electric field intensity thereby changing the pumping efficiency of the electro-rheological fluid vanes. In addition, by multi-staging, i.e., connecting the electro-rheological disk pumps in series, the electro-rheological fluid pressure can be increased.

An electro-rheological disk pump in accordance with the teachings of the present invention would employ a plurality of such modified rotor disks to form a multiple disk array rotor unit similar to that shown in FIG. 2. The number of disks and the interdisk spacing are varied according to specific pumping requirements. Each rotor disk 11 to 18 of rotor 2 in FIG. 2 could be modified with electrodes and conductive surfaces as taught by the present invention. Alternatively, only selected pairs of disks could be so modified. The inside facing surfaces of rotor hub 19 and end plate 20 could be modified with appropriate electrodes or conductive surfaces or the rotor disks adjacent to rotor hub 19 and end plate 20 could be mounted flush against rotor hub 19 and end plate 20 and only the surfaces of the two flush mounted disks facing the center of the rotor would be so modified. Voltage can be selectively placed on the electrodes by running insulated wires (not shown) or other forms of conductors along the pins 3, 4, 5 and 6 and through or onto the disks to the electrodes. The wires could run along or through end plate 19 to shaft 9 to a suitable power supply. Slip rings (not shown) could be employed to transfer electrical power to the shaft.

The advantages of the present invention are numerous.

The nature of the present electro-rheological disk pump design is inherently abrasion resistant. The electro-rheological disk pump requires no close tolerances. Therefore, the present invention eliminates the damage to the electro-rheological fluid particulate and reduces the abrasive wear of pump components associated with close tolerance pump construction. Furthermore, the electro-rheological fluid vanes are not subject to the abrasive effect of the electro-rheological fluid. In operation, new vanes are produced each time a voltage is applied to the electrodes during each new use.

The use of the electroviscous effect to produce electro-rheological fluid vanes between rotor disks increases the pumping efficiency of the electro-rheological disk pump as compared to standard disk pumps. The presence of vanes results in higher flow rates and discharge pressures than comparably sized flat disk pumps.

By controlling the electric field intensity which, in turn, controls the pumping efficiency of the electro-rheological fluid vanes, the electro-rheological disc pump of the present design can provide variable capacity and variable discharge pressure.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to he limiting but are merely preferred or exemplary embodiments thereof.

What is claimed is:

1. A rotary disk pump for pumping electro-rheological fluids comprising:

at least two disks having first and second faces;

means to coaxially mount said disks for rotation about their common axis; and each of said disks having means thereon to increase the viscosity of selective portions of the electro-rheological fluid being pumped.

2. A rotary disk pump for pumping electro-rheological fluids as defined in claim 1, wherein said disks are made of non-conductive material.

3. A rotary disk pump for pumping electro-rheological fluids as defined in claim 2, wherein the means to increase the viscosity of selective portions of the electro-rheological fluid being pumped comprises:

at least one electrode fixed to the first face of at least one of said disks;

at least one electrically conductive surface fixed to the second face of at least one of said disks wherein said electrically conductive surface faces toward said electrode of adjacent disks; and means for applying an electric voltage to said electrode whereby an electric field is produced between said electrode and said electrically conductive surface of adjacent disks.

4. A rotary disk pump for pumping electro-rheological fluids as defined in claim 3 wherein said electrodes are interspaced around said disks whereby there are alternating regions of conductive and non-conductive surfaces on the first face of said disks.

5. A rotary disk pump for pumping electro-rheological fluids as defined in claim 4 wherein said electrodes are in the shape of an impeller blade section.

6. A rotary disk pump for pumping electro-rheological fluids comprising:

at least two disks having opposed faces mounted for rotation about their common axis;

at least one of said disks having at least one electrode on one face;

at least one of said disks having at least one electrically conductive surface on the opposing face wherein said electrically conductive surface faces toward the electrode of the adjacent disk; and means to apply an electric charge to said electrodes whereby an electric field is produced between the electrodes and the electrically conductive surface of adjacent disks for increasing the viscosity of the electro-rheological fluid directly exposed to the electric field.

7. A rotary disk pump for pumping electro-rheological fluids as defined in claim 6 wherein said disks are made of non-conductive material.

8. A rotary disk pump for pumping electro-rheological fluids as defined in claim 8 wherein said electrodes are interspaced around said disks whereby there are alternating regions of conductive and non-conductive surfaces on the face of said disks.

9. A rotary disk pump for pumping electro-rheological fluids as defined in claim 8 wherein said electrodes are in the shape of an impeller blade section.

10. A device for pumping electro-rheological fluids comprising:

a casing defining an interior chamber;

a central inlet opening at one end of said chamber;

a discharge opening at the periphery of said chamber;

a rotor mounted within said chamber for rotation therein and comprising a plurality of coaxial disks having opposed faces disposed in substantially parallel alignment: and means for producing an electric field between one or more pairs of adjacent disks of said rotor for increasing the viscosity of the electro-rheological fluid directly exposed to the electric field.

11. A device for pumping electro-rheological fluids as defined in claim 10 wherein the disks of said rotor are made of non-conducting material which acts as an electrical insulator.

12. A device for pumping electro-rheological fluids as defined in claim 11 wherein the means for producing an electric field between one or more pairs of adjacent disks of said rotor comprises:

at least one electrode fixed to one face of at least one of said disks;

at least one electrically conductive surface fixed to the opposing face of at least one of said disks wherein said electrically conductive surface faces toward the electrode of adjacent disks; and means for applying an electric voltage to said electrode whereby an electric field is produced between the electrode and the electrically conductive surface of adjacent disks.

13. A device for pumping electro-rheological fluids as defined in claim 12 wherein the electrodes have a predetermined shape and are selectively placed on each disk of said rotor whereby there are alternating regions of conductive and non-conductive surfaces on the face of said disks.

14. A device for pumping electro-rheological fluids as defined in claim 12 wherein the electrically conductive surfaces have a predetermined shape and are selectively placed on each disk of said rotor in a position opposite to the placement of the electrodes of adjacent disks.

15. A device for pumping electro-rheological fluids as defined in claim 12 wherein the electrically conductive surfaces are placed on each disk of said rotor and cover the entire disk face.

16. A device for pumping electro-rheological fluids as defined in claim 12 wherein the electrodes and the electrically conductive surfaces are placed on selected pairs of adjacent disks of said rotor and positioned so that the electrically conductive surfaces faces toward the electrodes of adjacent disks.

17. A device for pumping electro-rheological fluids as defined in claim 16 wherein the electrodes have a predetermined shape and are selectively placed on the selected disks of said rotor whereby there are alternating regions of conductive and non-conductive surfaces on the face of said disks.

18. A device for pumping electro-rheological fluids as defined in claim 17 wherein the electrically conductive surfaces have a predetermined shape and are selectively placed on the selected disks in a position opposite to the placement of the electrodes of adjacent disks.

19. A device for pumping electro-rheological fluids as defined in claim 17 wherein the electrically conductive surfaces placed on the selected disks cover the entire disk face.

20. A device for pumping electro-rheological fluids comprising:

a casing defining an interior chamber;

an inlet opening at one end of said chamber positioned to direct the pumped electro-rheological fluid into the central portion of said chamber in an axial direction;

a discharge opening at the periphery of said chamber positioned to direct the pumped electro-rheological fluid out of said chamber in a tangential direction;

a shaft having opposing ends coaxial with said inlet opening and rotatably mounted at the end of said chamber opposite the inlet opening;

a rotor hub within said chamber rigidly connected to one end of said shaft;

an annular end plate within said chamber coaxially connected to said rotor hub and having a central inlet aperture;

a plurality of spaced disks having opposed planar faces disposed in substantially parallel alignment between said rotor hub and said annular end plate and connected together with said rotor hub and said annular end plate for rotation about their common axis and each said circular disk having a central aperture and wherein each said circular disk is made of a non-conducting material which acts as an electrical insulator;

at least one electrode embedded in one face of at least one of said disks said electrode having a predetermined shape and selectively placed on said disks whereby there are alternating regions of conductive and non-conductive surfaces on the face of said disk;

at least one electrically conductive surface fixed to the opposing face of at least one of said disks, said electrically conductive surface having a predetermined shape and selectively placed on said disks in a position opposite to the placement of the embedded electrodes of adjacent disks; and means for applying an electric voltage to said embedded electrode whereby an electric field is produced between the embedded electrode and the electrically conductive surface of adjacent disks of said rotor for increasing the viscosity of the electro-rheological fluid directly exposed to the electric field.

21. A device for pumping electro-rheological fluids as defined in claim 20 wherein the electrically conductive surfaces are placed on said disks and cover the entire face of said disks.

* * * * *